US006314724B1

(12) United States Patent
Kakuyama et al.

(10) Patent No.: US 6,314,724 B1
(45) Date of Patent: Nov. 13, 2001

(54) AIR-FUEL RATIO CONTROLLER AND METHOD OF CONTROLLING AIR-FUEL RATIO

(75) Inventors: Masatomo Kakuyama, Yokohama; Akira Tayama; Hirofumi Tsuchida, both of Yokosuka; Shigeaki Kakizaki, Yokohama, all of (JP)

(73) Assignee: Nissan Motor Co., Ltd., Kanagawa (JP)

( * ) Notice: Subject to any disclaimer, the term of this patent is extended or adjusted under 35 U.S.C. 154(b) by 0 days.

(21) Appl. No.: 09/715,181

(22) Filed: Nov. 20, 2000

(30) Foreign Application Priority Data

Nov. 30, 1999 (JP) ..... 11-339428

(51) Int. Cl.[7] ..... F01N 3/00

(52) U.S. Cl. ..... 60/285; 60/274; 60/277; 123/436

(58) Field of Search ..... 60/274, 276, 277, 60/285; 123/435, 436, 682; 701/109

(56) References Cited

U.S. PATENT DOCUMENTS

| | | | | |
|---|---|---|---|---|
| 3,916,170 | * | 10/1975 | Norimatsu et al. | 123/682 |
| 4,006,718 | * | 2/1977 | Konomi | 60/277 |
| 4,393,839 | * | 7/1983 | Kataoka | 123/682 |
| 5,035,220 | * | 7/1991 | Uchinami et al. | 123/436 |
| 5,345,911 | * | 9/1994 | Kadowaki et al. | 123/436 |
| 5,735,246 | * | 4/1998 | Vincent et al. | 123/436 |
| 5,743,085 | * | 4/1998 | Takaku et al. | 60/285 |
| 5,765,532 | * | 6/1998 | Loye | 123/435 |
| 5,842,340 | * | 12/1998 | Bush et al. | 60/274 |
| 5,909,724 | * | 6/1999 | Nishimura et al. | 123/436 |
| 5,913,299 | * | 6/1999 | Shimizu et al. | 123/436 |
| 5,941,211 | * | 8/1999 | Brehob et al. | 60/285 |
| 6,092,369 | * | 7/2000 | Hosogai et al. | 60/285 |

FOREIGN PATENT DOCUMENTS

| | | |
|---|---|---|
| 6-249028 A | 9/1994 | (JP) . |
| 9-310635 A | 12/1997 | (JP) . |

* cited by examiner

*Primary Examiner*—Thomas Denion
*Assistant Examiner*—Tu M. Nguyen
(74) *Attorney, Agent, or Firm*—Shinjyu Global IP Counselors, LLP

(57) ABSTRACT

An air-fuel ratio controller for an internal combustion engine with a catalytic converter in an exhaust passage has an air-fuel ratio sensor, an engine sensor, and a control unit. The air-fuel ratio sensor produces a signal indicative of an air-fuel ratio of an exhaust gas in the exhaust passage on an upstream side of the catalytic converter. The engine sensor produces a signal indicative of misfiring of the engine. The control unit is operatively coupled to the air-fuel ratio sensor and the engine sensor. The control unit computes an estimated quantity of oxygen to be stored in the catalytic converter based on the signal from the air-fuel ratio sensor, and determines if the engine is misfiring based on the signal from the engine sensor. The control unit also produces an estimated adjustment value and adjusts an air-fuel ratio of intake air based on the estimated adjustment value such that the estimated quantity of oxygen to be stored substantially coincides with a predetermined target quantity of oxygen to be stored. However, when misfiring is determined based on the signal from the engine sensor, the computation of the estimated quantity of oxygen to be stored is stopped or not used, and a predetermined value is used to control the air-fuel ratio of intake air. With the air-fuel ratio controller of the present invention, influence of misfiring on air-fuel ratio control can be reduced.

20 Claims, 4 Drawing Sheets

AIR-FUEL RATIO CONTROLLER AND METHOD OF CONTROLLING AIR-FUEL RATIO

BACKGROUND OF THE INVENTION

1. Field of the Invention

This invention generally relates to an air-fuel ratio controller for an internal combustion engine. More specifically, the present invention relates to an air-fuel ratio controller having a catalytic converter.

2. Background Information

A catalytic converter is an emission control device in an exhaust stream that chemically treats or purifies exhaust gas discharged from an internal combustion engine of a vehicle. Once a mixture of air and gas is fed into cylinders of the internal combustion engine, the mixture is subjected to combustion and explosion within the cylinders. Then, the gas is discharged from the cylinders as an exhaust gas, which contains environmental pollutants such as hydrocarbons (HC), carbon monoxide (CO), and nitrogen oxide (NOx). The catalytic converter is disposed in an exhaust passage to purify such pollutants.

It is well known to utilize a catalytic converter with a three-way catalyst in the exhaust passage to remove HC, CO, and $NO_x$, from the exhaust gas. The catalyst of the three-way catalytic converter oxidizes HC and CO, and deoxidizes $NO_x$. For the three-way catalytic converter to be able to perform both oxidization and deoxidization efficiently, the air-fuel ratio of the exhaust gas needs to be in the vicinity of the stoichiometric air-fuel ratio. Since three-way catalytic converters are well known in the art, the structure and function of a three-way catalytic converters would be obvious to one of ordinary skill in the art without further explanation herein. An air-flow controller or carburetor is a device that controls the air-fuel ratio. In the air-flow controller, an air-fuel ratio sensor has been arranged in the exhaust passage on the upstream side of the three-way catalytic converter to detect the air-fuel ratio of the exhaust gas.

Generally, the air-fuel ratio of the exhaust gas becomes greater than the stoichiometric air-fuel ratio (lean air-fuel ratio) during acceleration of the vehicle due to an increase in air intake. Conversely, the air-fuel ratio becomes smaller than the stoichiometric air-fuel ratio (rich air-fuel ratio) during deceleration of the vehicle. To allow the three-way catalytic converter to operate efficiently even when the air-fuel ratio of the exhaust gas fluctuates, it has been proposed to utilize a three-way catalytic converter having the ability to store oxygen ($O_2$). In this arrangement, the three-way catalytic converter has an oxygen absorbent material for storing oxygen in the catalytic converter. The quantity of oxygen to be stored in the three-way catalytic converter is calculated based on the deviation of the air-fuel ratio of the exhaust gas from the stoichiometric air-fuel ratio. Further, as disclosed in Japanese Laid-Open Japanese Patent Publication No. H6-249028, the air-fuel ratio of the intake air-fuel mixture is controlled so that the estimated amount of oxygen to be stored in the three-way catalytic converter matches a target value, such as roughly half the oxygen storage limit value of the oxygen absorbent material of the three-way catalytic converter.

In this catalytic converter, when the air-fuel ratio of the exhaust gas is greater than the stoichiometric air-fuel ratio, i.e., a lean mixture, oxygen adsorbs onto the oxygen absorbent material of the three-way catalytic converter. Conversely, when the air-fuel ratio of the exhaust gas is smaller than the stoichiometric air-fuel ratio, i.e., a rich mixture, oxygen desorbs from the oxygen absorbent material of the three-way catalytic converter. Since the rate at which oxygen desorbs from the three-way catalytic converter is slower than the rate at which oxygen adsorbs onto the three-way catalytic converter, it has been proposed in Japanese Laid-Open Japanese Patent Publication No. 9-310635 to adjust the quantity of oxygen to be stored based on whether the oxygen is adsorbed or desorbed.

However, with this kind of device, when a cylinder of the engine misfires, unburned fuel and air enter the three-way catalytic converter. Consequently, the air-fuel ratio sensor cannot measure the air-fuel ratio accurately, and also the quantity of oxygen stored in the three-way catalytic converter cannot be accurately computed.

Basically, when misfiring occurs, if the quantity of oxygen to be stored continues to be calculated based on the output of the air-fuel sensor, a gap will develop between the computed value and the actual value of the quantity of oxygen stored in the three-way catalytic converter. Accordingly, the air-fuel ratio will be controlled based on an incorrect value.

In view of the above, there exists a need for an air-fuel ratio controller which overcomes the above mentioned problems in the prior art. This invention addresses his need in the prior art as well as other needs, which will become apparent to those killed in the art from this disclosure.

SUMMARY OF THE INVENTION

The object of this invention is to provide an air-fuel controller for internal combustion engine, which can accurately control the air-fuel ratio without being affected by misfiring.

This object is basically attained by providing an air-fuel ratio controller for an internal combustion engine with a catalytic converter in an exhaust passage and has an air-fuel ratio sensor, an engine sensor, and a control unit. The air-fuel ratio sensor produces a signal indicative of an air-fuel ratio of an exhaust gas in the exhaust passage on an upstream side of the catalytic converter. The engine sensor produces a signal indicative of misfiring of the engine. The control unit is operatively coupled to the air-fuel ratio sensor and the engine sensor. The control unit computes an estimated quantity of oxygen to be stored in the catalytic converter based on the signal from the air-fuel ratio sensor, and determines if the engine is misfiring based on the signal from the engine sensor. The control unit also produces an estimated adjustment value and adjusts an air-fuel ratio of intake air-fuel mixture based on the estimated adjustment value such that the estimated quantity of oxygen to be stored substantially coincides with a predetermined target quantity of oxygen to be stored. However, when misfiring is determined based on the signal from the engine sensor, a predetermined value is used to control the air-fuel ratio of intake air-fuel mixture.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following description of the embodiments of the present invention are provided for illustration only, and not for the purpose of limiting the invention as defined by the appended claims and their equivalents.

FIRST EMBODIMENT

Figure 1:
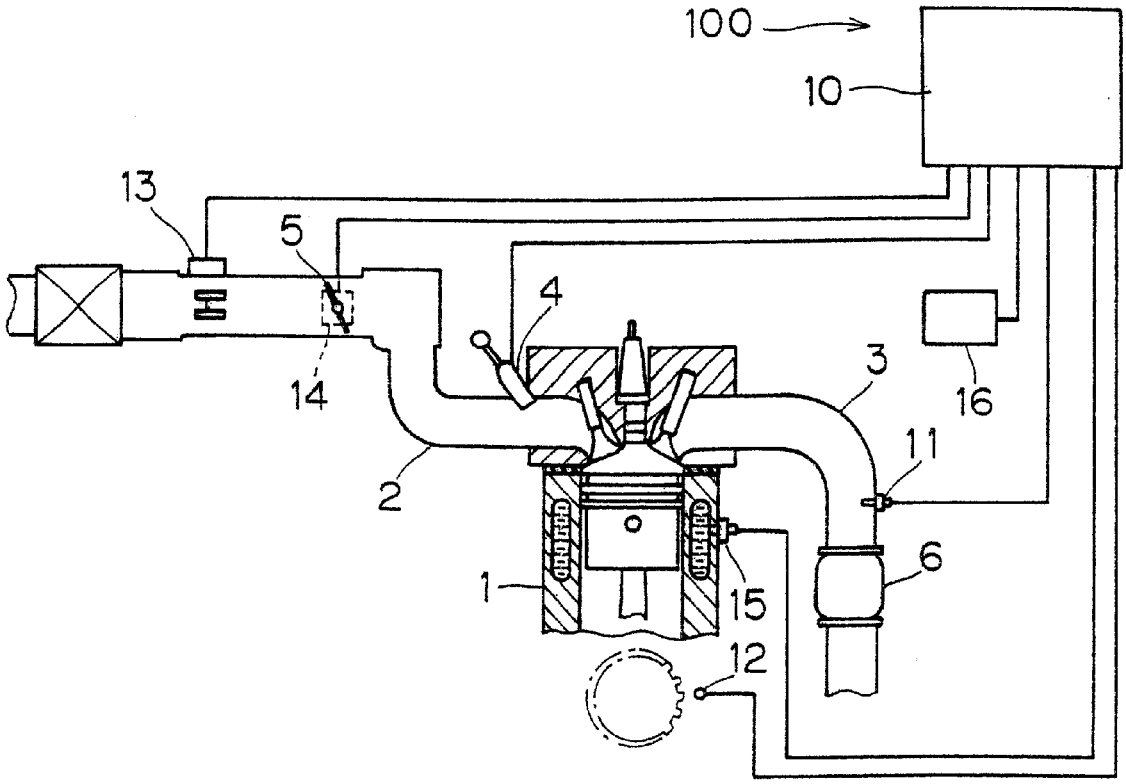
FIG. 1 is a schematic view of a portion of an engine system with an air-fuel ratio controller in accordance with a first embodiment of the present invention.

FIG. 1 shows a schematic illustration of an air-fuel controller 100 in accordance with the first embodiment of the present invention as installed in a portion of an engine system. The engine system includes an engine body 1, an intake passage 2, an exhaust passage 3, a fuel injection valve 4, and a throttle valve 5. Throttle valve 5 is disposed inside intake passage 2. Since engine systems and their parts are well known in the art, the structure and function of the engine system and its parts would be obvious to one of ordinary skill in the art without further explanation herein.

The air-fuel controller 100 includes a three-way catalytic converter 6, a control unit 10, an air-fuel ratio sensor 11, an engine rotational speed sensor or a crank angle sensor 12, an intake airflow sensor 13, a throttle valve position sensor 14, a coolant temperature sensor 15, and a vehicle speed sensor 16. Three-way catalytic converter 6 is installed in exhaust passage 3, and includes a three-way catalyst and an oxygen absorbent material. Since catalytic converters are well known in the art, the structure and function of catalytic converter 6 will not be discussed or illustrated herein. Accordingly, it will further be apparent to those skilled in the art that the catalytic converter 6 can use any catalyst and any oxygen absorbent material that will carry out the present invention.

The various components and/or programs of control unit 10 form oxygen storage quantity computing means, which can also be considered to be controlling means, determining means, and/or computation stopping means. Control unit 10 preferably includes a microcomputer with an oxygen storage quantity computing program that controls the air-fuel ratio. Control unit 10 can also include other conventional components such as an input interface circuit, an output interface circuit, and storage devices such as a ROM (Read Only Memory) device and a RAM (Random Access Memory) device. Control unit 10 is operatively coupled to air-fuel ratio sensor 1, engine rotational speed sensor 12, intake airflow sensor 13, throttle valve position sensor 14, coolant temperature sensor 15, and vehicle speed sensor 16. The various components and/or programs of control unit 10 form a computing portion, a determining portion and a controlling portion, which all cooperate together to process the measurements of the sensors 11–16. These portions of control unit 10 can each be a separate part or component of control unit 10. Alternatively, one or more parts or components of control unit 10 can perform one or more of the functions of these portions of control unit 10. Thus, these portions of control unit 10 receives measurements from the sensors 11–16 to control the quantity of fuel injected by the fuel injection valve 4 based on the computed quantity of oxygen stored in three-way catalytic converter 6.

The absorbent material of three-way catalytic converter 6 adsorbs the oxygen in the exhaust gas when the air-fuel ratio of the exhaust gas is leaner than the stoichiometric air-fuel ratio. The oxygen in the exhaust gas is desorbed from the absorbent material of three-way catalytic converter 6 when the air-fuel ratio of the exhaust gas is richer than the stoichiometric air-fuel ratio. In this manner, the air-fuel ratio within three-way catalytic converter 6 is maintained in the vicinity of the stoichiometric air-fuel ratio, such that the reactions within three-way catalytic converter 6 remove the HC, CO, and $NO_x$, from the exhaust gas.

Air-fuel ratio sensor 11 is arranged in exhaust passage 3 on the upstream side of three-way catalytic converter 6 to measure properties of the exhaust gas indicative of the air-fuel ratio therein. The air-fuel ratio of the exhaust gas entering three-way catalytic converter 6 is effectively measured. This measurement is converted to an electrical signal indicative of the air-fuel ratio of the exhaust gas. The signal from airfuel ratio sensor 11 is inputted to control unit 10, which computes the air-fuel ratio of the exhaust gas entering three-way catalytic converter 6.

Engine rotational speed sensor 12 measures the RPM and crank angle of the engine. The measurements of the engine rotational speed sensor 12 are converted to an electrical signal that is sent to control unit 10. Intake airflow sensor 13 measures the quantity of air entering the engine, and thus, the load to the engine. Throttle position sensor 14 measures the position of throttle valve 5. Coolant temperature sensor 15 measures the temperature of the engine coolant. Vehicle speed sensor 16 measures the vehicle speed. These sensors 12–16 are provided to detect or measure various operating conditions of the engine, and then produce electrical signals that represent the measurement. The electrical signals from these sensors 12–16 are also inputted to control unit 10 for controlling the air-fuel ratio as explained below.

Since sensors such as sensors 11–16 are well known in the art, the structure and functions of the sensors 11–16 would be obvious to one of ordinary skill in the art without further explanation herein. Accordingly, it will be apparent to those skilled in the art from this disclosure that sensors 11–16 can be any type of sensors that will carry out the present invention.

Based on these sensor signals from sensors 11–16, the computing portion of control unit 10 (oxygen storage quantity computing means) computes an estimated quantity of oxygen to be stored in three-way catalytic converter 6. Then, control unit 10 operatively controls the quantity of fuel injected by fuel injection valve 4 based on the estimated quantity of oxygen stored in three-way catalytic converter 6. The air-fuel ratio of the intake air-fuel mixture is then adjusted in any conventional manner, such that the estimated quantity of oxygen to be stored in three-way catalytic converter 6 from the exhaust gas of the intake air-fuel mixture substantially coincides with a target quantity of oxygen to be stored in three-way catalytic converter 6. When the engine misfires, the computation of the estimated quantity of oxygen to be stored in three-way catalytic converter 6, is stopped or the computation of the estimated quantity of oxygen to be stored in three-way catalytic converter 6 is merely not used even though the computation continues to be performed.

Control unit 10 controls the air-fuel ratio of intake air in the following manner. Once the estimated quantity of oxygen to be stored in three-way catalytic converter 6 has been computed, control unit 10 then compares the estimated quantity of oxygen to be stored with a target quantity of oxygen to be stored in three-way catalytic converter 6. The determining portion of control unit 10 then determines how much adjustment needs to be made to the intake air-fuel mixture ratio of the intake air in order to make the estimated quantity of oxygen to be stored in three-way catalytic converter 6 to substantially coincide with the target quantity of oxygen to be stored in three-way catalytic converter 6. Accordingly, control unit 10 is constantly measuring the air-fuel ratio of exhaust gas entering three-way catalytic converter 6 to compute the estimated quantity of oxygen to be stored in three-way catalytic converter 6. If the estimated value does not substantially coincide with the target value, then the control unit 10 will keep adjusting the air-fuel ratio of the intake air until a future estimated value of the estimated quantity of oxygen to be stored in the catalytic converter 6 substantially coincides with the target value or quantity of oxygen to be stored in three-way catalytic converter 6.

Figure 2:
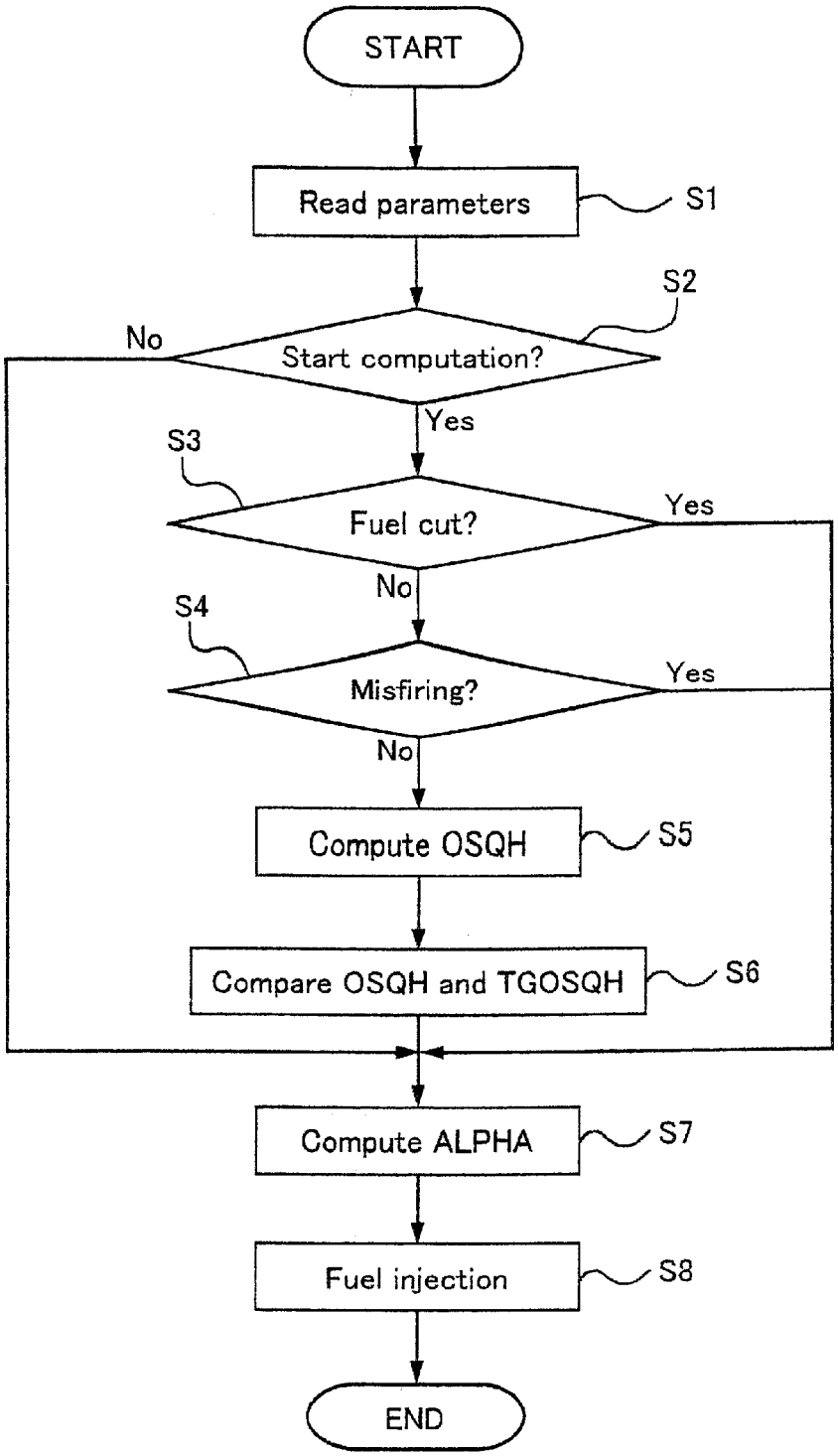
FIG. 2 is a flowchart showing an air-fuel ratio control performed by the air-fuel ratio controller in accordance with the first embodiment of the present invention.

Next, the details of the air-fuel ratio control operation performed by control unit 10 are explained referring to the flowchart shown in FIG. 2. This control operation is continuously performed every prescribed control period of time when the appropriate operating conditions are met. The prescribed control period of time can be, for example, every cycle of the engine or an increment of an engine cycle or every 10 milliseconds.

As shown in FIG. 2, in step SI, the measuring portion of control unit 10 reads and/or computes a detected air-fuel ratio (AFSABF) from air-fuel ratio sensor 11, an engine rotational speed (Ne) from engine rotational speed sensor 12, a quantity of intake airflow (Qa) from intake airflow sensor 13, a throttle valve position from throttle position sensor 14, an engine coolant temperature from coolant temperature sensor 15, and a vehicle speed from vehicle speed sensor 16. The speed or rate of adsorbing or desorbing oxygen (ADSspeed) for the particular three-way catalytic converter 6 is also stored in the measuring portion of the control unit 10. These data are used as parameters for computing the estimated quantity of oxygen to be stored for determining whether conditions for computation have been satisfied, and for adjusting the air intake air-fuel mixture ratio.

In step S2, the determining portion of control unit 10 determines whether conditions have been satisfied for starting the computation of the quantity of oxygen to be stored. These conditions include that the engine has warmed up, and that threeway catalytic converter 6 is in the activated state. Basically, the conditions are satisfied when the engine coolant temperature is at or above a predetermined temperature such as 60° C., such that the catalytic converter 6 is properly operating. Typically, the catalytic converter 6 operates at temperatures in excess of about 815.5° C.

In step S3, the determining portion of control unit 10 determines whether fuel supply to the engine is being cut, or stopped. For example, fuel supply from fuel injection valve 4 is cut when the engine enters into a predetermined deceleration operation. Control unit 10 performs this determination based on the engine speed Ne, the throttle valve position, and the vehicle speed. For instance, control unit 10 determines that the engine is in the predetermined deceleration operation when the engine speed Ne is above 1800 rpm, the throttle valve angle is 0 degree, and the vehicle speed is above 10 km/h.

In step S4, the determining portion of control unit 10 acts as means that determines whether there is a misfiring in the cylinders of the engine. Control unit 10 makes this determination based on the signal from engine rotational speed sensor 12, which is indicative of misfiring of the engine. In particular, the crank angular velocity for each cylinder during the power stroke is compared with the average value of the crank angular velocity over several immediately preceding engine cycles. In that case, a misfiring is recognized when the difference between the crank angle of each cylinder and the average crank angle exceeds a predetermined value based on the current operating conditions. Alternatively, cylinder pressure sensors can be provided in the cylinders to detect the pressure therein and to compare the cylinder pressure with a reference pressure that is based on the operating conditions. A misfiring can be recognized when the difference between the pressure of each cylinder and the reference pressure exceeds a predetermined value based on the current operating conditions. For instance, the predetermined value is 5 kg/cm$^2$. Still alternatively, a misfiring can be determined using any of a variety of other known methods and/or sensors for detecting misfiring.

The controlling portion of control unit 10 (computation stopping means) proceeds to steps S5 and S6 when fuel is not being cut (stopped or reduced below a predetermined rate) and there is no misfiring.

In step S5, the computing portion of control unit 10 computes the estimated quantity of oxygen to be stored (OSQH) in three-way catalytic converter 6. The OSQH value is the quantity of oxygen that needs to be stored in three-way catalytic converter 6 in order to achieve the stoichiometric air-fuel ratio with the detected air-fuel ratio of the exhaust gas. This OSQH value can be computed using the following equation (1), which is based on a deviation of the detected air-fuel ratio (AFSABF) detected by air-fuel ratio sensor 11 from the stoichiometric air-fuel ratio (AFSM):

$$OSQH=[(AFSABF-AFSM)/AFSM]\times Qa\times ADSspeed+HSOSQ \quad (1),$$

Where HSOSQ is the computed or estimated quantity of oxygen to be stored computed in the previous cycle.

Since a rate of adsorption is generally greater than a rate of desorption, ADSspeed is relatively large when the detected air-fuel ratio (AFSABF) is lean, and relatively small when the detected air-fuel ratio (AFSABF) is rich.

Accordingly, the estimated quantity of oxygen to be stored (OSQH) increases when the detected air-fuel ratio (AFSABF) is leaner than stoichiometric air-fuel ratio AFSM (i.e., AFSABF−AFSM>0). Conversely, the OSQH decreases when the detected air-fuel ratio is richer than stoichiometric air-fuel ratio AFSM (i.e., AFSABF−AFSM<0).

In step S6, the computing portion of control unit 10 finds the deviation of the estimated quantity of oxygen to be stored (OSQH) from a target quantity of oxygen to be stored (TGOSQH). Preferably, the target quantity of oxygen to be stored (TGOSQH) is roughly half the maximum oxygen storage quantity of the oxygen absorbent material of three-way catalytic converter 6. Since the maximum oxygen storage quantity for a catalytic converter that is being used can be computed in a manner that is well known in the art, it would be obvious to one of the ordinary skill in the art how to compute the target quantity of oxygen to be stored (TGOSOH) without further explanation herein.

In step S7, the computing portion of control unit 10 calculates a target air-fuel ratio adjustment multiplier (ALPHA) using proportional-plus-integral-plus-derivative equation (2) based on the deviation of the estimated quantity of oxygen to be stored (OSQH) from the target quantity of oxygen to be stored (TGOSQH):

$$ALPHA=(AFSM/[1-(TGOSQH-OSQH)\times PID/Qa]-AFSABF)/AFSABF\times PID \quad (2),$$

where PID is the proportional-plus-integral-plus-derivative gain.

ALPHA is an estimated adjustment value or multiplier that is used to adjust the air-fuel ratio of the intake air to be inputted in three way catalytic converter 6 such that the estimated quantity of oxygen to be stored in the three-way catalyst of the catalytic converter 6 from the exhaust gas of the intake air substantially coincides with the target quantity of oxygen to be stored (TGOSQH). If the current preadjustment estimated quantity of oxygen to be stored (OSQH) is larger than the target quantity of oxygen to be stored (TGOSQH), i.e., TGOSQH−OSQH<0, the target air-fuel ratio adjustment multiplier ALPHA makes the adjusted air-fuel ratio of the intake air rich. Conversely, if the current computed or estimated quantity of oxygen to be stored (OSQH) is smaller than the target quantity of oxygen to be stored (TGOSQH), i.e., TGOSQH−OSQH>0 the target air-fuel ratio adjustment multiplier (ALPHA) makes the adjusted air-fuel ratio of the intake air-fuel mixture lean.

In step S8, the controlling portion of the control unit 10 sets (increases or decreases) the quantity of fuel to be injected into the intake air so that the exhaust air is adjusted for increasing or decreasing the quantity of oxygen to be stored in threeway catalytic converter 6. The fuel injection quantity is obtained by multiplying the basic fuel injection quantity (constant K×Qa/Ne), which is obtained from the engine speed (Ne) and the intake airflow (Qa), with the target air-fuel ratio adjustment multiplier (ALPHA). In other words, the fuel injection quantity is equal to ALPHA×K×Qa×Ne, where K is a predetermined constant for the particular engine.

Meanwhile, when the determining portion of control unit 10 finds that fuel is being cut in step S3, the control unit 10 skips steps S5 and S6, and jumps to steps S7 and S8. In steps S7 and S8, when the fuel is being cut, control unit 10 sets the target air-fuel ratio adjustment multiplier (ALPHA) to 1. Since the fuel is being cut, the fuel injection quantity to 0. At the same time, the controlling portion of control unit 10 stops computation of the estimated quantity of oxygen to be stored (OSQH).

Once the engine returns to its original operation after the fuel cut, the maximum oxygen storage quantity of three-way catalytic converter 6 can be utilized in step S5 as the computed or estimated quantity of oxygen to be stored (OSQH) to recommence the computation.

When control unit 10 recognizes a misfiring in step S4, control unit 10 skips steps S5 and S6 and jumps to steps S7 and S8. When a misfiring is detected, control unit 10 stops computation of the estimated quantity of oxygen to be stored (OSQH) in three-way catalytic converter 6. Of course, the computation does not need to be stopped, but merely not used during misfiring of the engine. At the same time, control unit 10 also sets or fixes the estimated quantity of oxygen to be stored (OSQH) in three-way catalytic converter 6 at the immediately preceding computed value. In other words, the previously computed quantity of oxygen to be stored (HSOSQ) is used during misfiring as the estimated quantity of oxygen to be stored. Accordingly, during misfiring, control unit 10 calculates target air-fuel ratio adjustment multiplier (ALPHA) using this fixed or predetermined value (HSOSQ) as the estimated quantity of oxygen to be stored (OSQH).

SECOND EMBODIMENT

Figure 3:
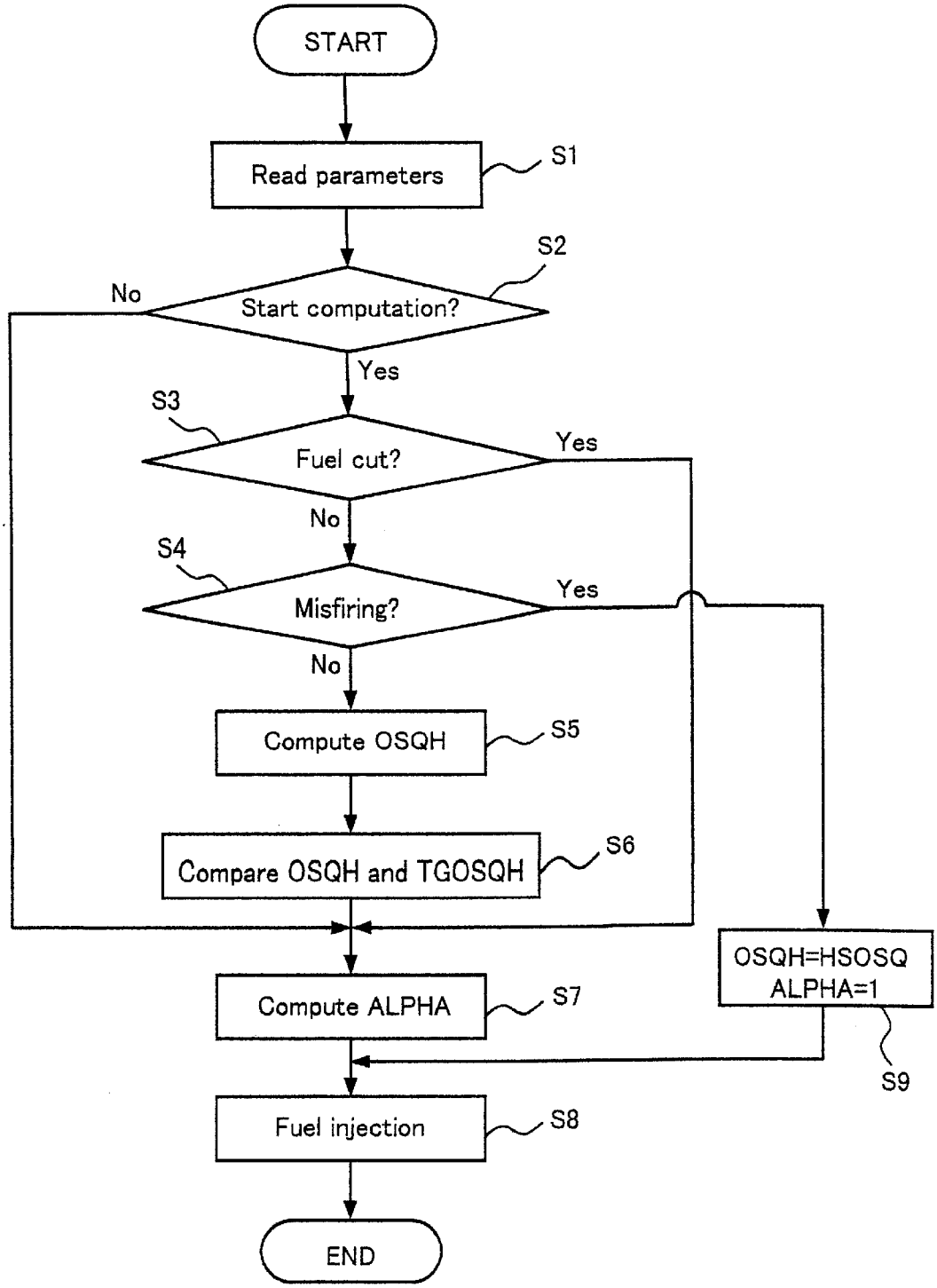
FIG. 3 is a flowchart showing an air-fuel ratio control performed by the air-fuel ratio controller in accordance with the second embodiment of the present invention.

Referring now to FIG. 3, a flow chart is illustrated that represents a program used in control unit 10 of FIG. 1 in accordance with a second embodiment of the present invention. In view of the similarity between the flow charts of the first and second embodiments, the steps having the same function are given the identical reference numerals. Moreover, explanation of components and operations that function in a similar manner as in the first embodiment will be omitted. Only the operations that are different in function will be explained herein.

FIG. 3 shows a flowchart of an air-fuel ratio control performed by the airfuel ratio controller 100 in accordance with the second embodiment of the present invention. The flowchart is basically the same as the flowchart of the first embodiment shown in FIG. 2, except that the flowchart of the second embodiment further includes step S9. When the control unit 10 determines that there is a misfiring in the engine at step S4, the control unit 10 proceeds to step S9. In step S9, the control unit 10 stops computation of the estimated quantity of oxygen to be stored (OSQH). At the same time, it also sets or fixes the computed or estimated quantity of oxygen to be stored (OSQH) at the immediately preceding computed value. In other words, the previously computed quantity of oxygen to be stored (HSOSQ) is used during misfiring. However, unlike in the first embodiment, control unit 10 in this second embodiment sets or fixes the value of target air-fuel ratio adjustment multiplier (ALPHA) at 1, such that the fuel injection quantity will not be adjusted during misfiring.

Figure 4:
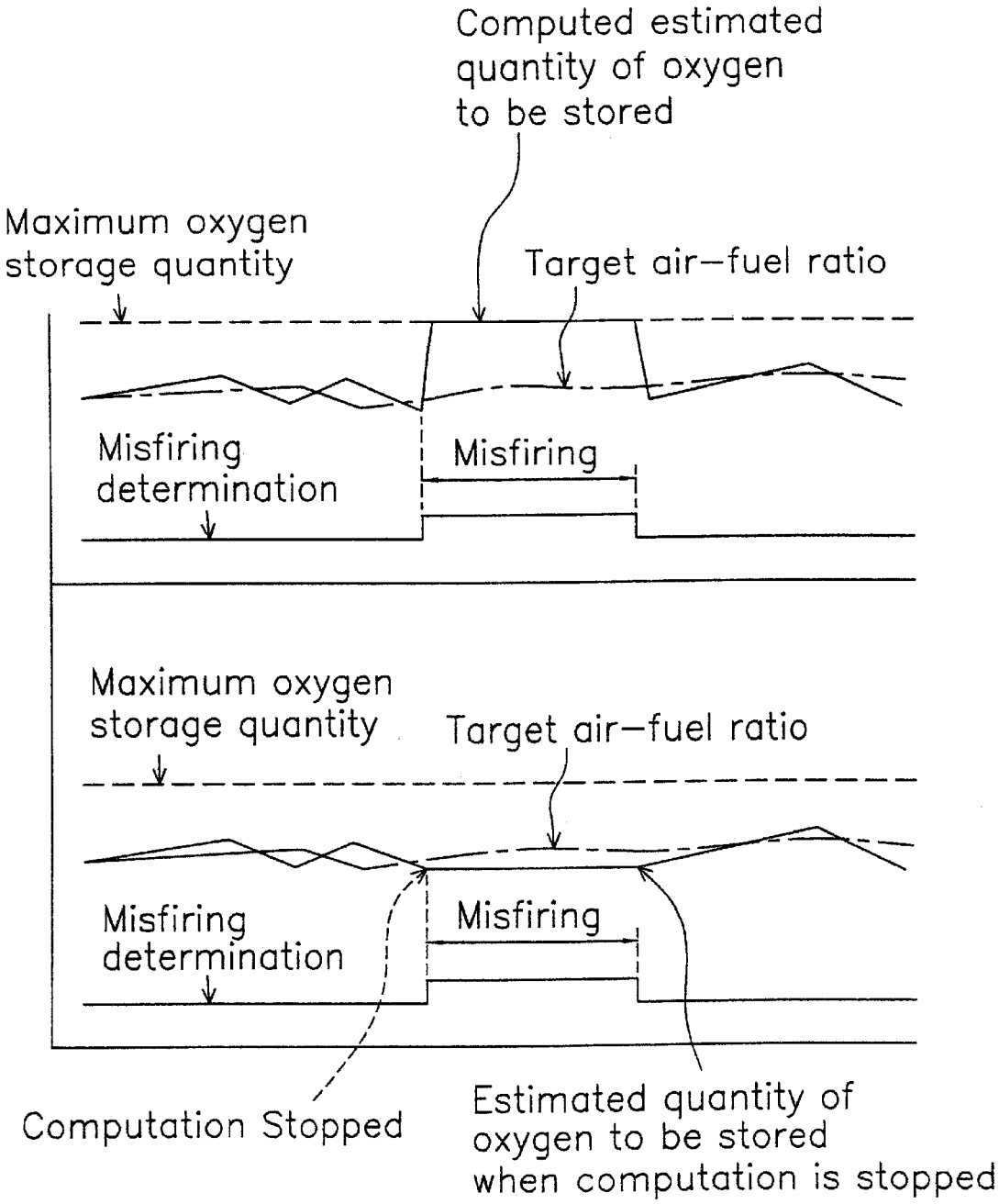
FIG. 4 is a timing chart that shows the estimated quantity of oxygen being stored in the three-way catalytic converter in accordance with the selected embodiments of the present invention.

When a misfiring occurs in a cylinder of the engine, unburned fuel and air enter three-way catalytic converter 6. Consequently, air-fuel ratio sensor 11 cannot accurately measure the air-fuel ratio with a conventional air-fuel controller. Accordingly, inconsistency develops between the estimated quantity of oxygen to be stored in three-way catalytic converter 6 and the actual quantity of oxygen stored therein. With the above-described configuration, however, the computation of the estimated quantity of oxygen to be stored is stopped or not used during misfiring. Once a misfiring is detected, the estimated quantity of oxygen to be stored is fixed or set at the value computed immediately before the misfiring or the value of target airfuel ratio adjustment multiplier is set to 1 such that the air-fuel ratio is not being adjusted. In the meantime, since the engine is not burning during misfiring, more oxygen enters three-way catalytic converter 6. Consequently, as shown in the timing chart in FIG. 4, when the computation of estimated quantity of oxygen to be stored is not stopped after misfiring, the estimated quantity of oxygen to be stored reaches and stays at the maximum oxygen storage quantity during misfiring. Therefore, control of the air-fuel ratio is performed based on this computed estimated quantity of oxygen to be stored. On the other hand, when the estimated quantity of oxygen to be stored is fixed or set at the previously computed quantity of oxygen to be stored, the control of the air-fuel ratio by the air-fuel ratio controller 100 is not affected by the misfiring.

Thus, during misfiring, it is possible to avoid setting the target air-fuel ratio and controlling the air-fuel ratio based on an incorrect estimated quantity of oxygen to be stored. Furthermore, since the target air-fuel ratio adjustment multiplier is set while the computed quantity of oxygen to be stored is fixed or set at the value computed immediately before the misfiring, the air-fuel ratio can be controlled without straying greatly from the target air-fuel ratio during and misfiring.

The terms of degree such as "substantially", "about" and "approximately" as used herein mean a reasonable amount of deviation of the modified term such that the end result is not significantly changed. These terms should be construed as including a deviation of ±5% of the modified term if this would not negate the meaning of the word it modifies.

This application claims priority to Japanese Patent Application No. H11-339428. The entire disclosure of Japanese Patent Application No. H11-339428 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. An air-fuel ratio controller for an internal combustion engine with a catalytic converter in an exhaust passage, said air-fuel ratio controller comprising:

an air-fuel ratio sensor that produces a signal indicative of an air-fuel ratio of an exhaust gas in the exhaust passage on an upstream side of the catalytic converter;

an engine sensor that produces a signal indicative of misfiring of the engine; and a control unit operatively coupled to said air-fuel ratio sensor and said engine sensor, wherein said control unit computes an estimated quantity of oxygen to be stored in the catalytic converter based on said signal from said air-fuel ratio sensor, determines if the engine is misfiring based on said signal from said engine sensor, and produces an estimated adjustment value and adjusts an air-fuel ratio of intake air fuel mixture based on said estimated adjustment value such that said estimated quantity of oxygen to be stored substantially coincides with a predetermined target quantity of oxygen to be stored, except when misfiring is determined based on said signal from said engine sensor, in which case a predetermined value is used to control said air-fuel ratio of said intake air-fuel mixture.

2. The air-fuel ratio controller as set forth in claim 1, wherein computation of said estimated quantity of oxygen to be stored is stopped when misfiring is determined by said control unit.

3. The air-fuel ratio controller as set forth in claim 1, wherein said predetermined value is said estimated quantity of oxygen to be stored that was computed immediately before the misfiring was determined.

4. The air-fuel ratio controller as set forth in claim 1, wherein said predetermined value is set such that said air-fuel ratio of said intake air-fuel mixture remains unchanged when misfiring is determined.

5. The air-fuel ratio controller as set forth in claim 1, further comprising a temperature sensor operatively coupled to said control unit to produce a signal indicative of engine temperature, such that said control unit determines if operating conditions are met to start computing said estimated quantity of oxygen to be stored.

6. The air-fuel ratio controller as set forth in claim 1, further comprising a vehicle speed sensor operatively coupled to said control unit to produce a signal indicative of vehicle speed, and a throttle valve position sensor operatively coupled to said control unit to produce a signal indicative of throttle valve position, said control unit adjusting said air-fuel ratio of said intake air-fuel mixture based on said predetermined value instead of said estimated adjustment value when at least one of said vehicle speed sensor, said throttle valve position sensor and said engine sensor produces a signal that is indicative of fuel being cut.

7. The air-fuel ratio controller as set forth in claim 1, further comprising an intake airflow sensor operatively coupled to said control unit to produce a signal indicative of a quantity of intake airflow entering cylinders of the engine, said control unit setting a quantity of fuel to be injected into said intake air based on said signal of said intake airflow sensor, said signal of said engine sensor and at least one of said estimated adjustment value and said predetermined value.

8. An air-fuel ratio controller for an internal combustion engine with catalytic converter in an exhaust passage, said air-fuel ratio controller comprising:

oxygen storage quantity computing means for computing an estimated quantity of oxygen to be stored in the catalytic converter based on a signal indicative of an air-fuel ratio of an exhaust gas in the exhaust passage on an upstream side of the catalytic converter;

first control means for producing an estimated adjustment value and adjusting an air-fuel ratio of intake air-fuel mixture based on said estimated adjustment value such that said estimated quantity of the oxygen to be stored substantially coincides with a predetermined target quantity of the oxygen to be stored;

determining means for determining if the engine is misfiring based on a signal indicative of misfiring of the engine; and second control means for adjusting said air-fuel ratio of said intake air-fuel mixture based on a predetermined value when misfiring is determined by said determining means.

9. The air-fuel ratio controller as set forth in claim 8, wherein said second control means stops computation of said estimated quantity of oxygen to be stored performed by said oxygen storage quantity computing means when misfiring is determined by said determining means.

10. The air-fuel ratio controller as set forth in claim 8, wherein said predetermined value is set based on said estimated quantity of oxygen to be stored that was set immediately before the misfiring was determined.

11. The air-fuel ratio controller as set forth in claim 8, wherein said predetermined value is set such that said air-fuel ratio of said intake air-fuel mixture remains unchanged when misfiring is determined.

12. The air-fuel ratio controller as set forth in claim 8, further comprising air-fuel sensing means for producing said signal indicative of said air-fuel ratio of the exhaust gas.

13. The air-fuel ratio controller as set forth in claim 8, further comprising engine sensing means for producing said signal indicative of the misfiring of the engine.

14. The air-fuel ratio controller as set forth in claim 8, further comprising temperature sensing means for producing a signal indicative of engine temperature, said temperature sensing means being operatively coupled to said control unit for determining if the catalytic converter is at a predetermining operating condition to start computing said estimated quantity of oxygen to be stored.

15. The air-fuel ratio controller as set forth in claim 13, further comprising vehicle speed sensing means for producing a signal indicative of vehicle speed, said vehicle speed sensing means being operatively coupled to said second control means, and throttle valve positioning sensing means for producing a signal indicative of said throttle valve position, said throttle valve positioning sensing means being operatively coupled to said second control means, said second control means adjusting said air-fuel ratio of said intake air-fuel mixture based on said predetermined value instead of said estimated adjustment value when at least one of said vehicle speed sensing means, said throttle valve positioning means and said engine sensing means produces a signal that is indicative of fuel being cut.

16. The air-fuel ratio controller as set forth in claim 13, further comprising intake airflow sensing means producing a signal indicative of a quantity of intake airflow entering cylinders of the engine, said intake airflow sensing means being operatively coupled to said first and second control means, said first and second control means setting a quantity of fuel to be injected into said intake air based on said signal of said intake airflow sensing means, said signal of said engine sensing means and at least one of said estimated adjustment value and said predetermined value.

17. A method of controlling an air-fuel ratio of an exhaust gas for an internal engine having a catalytic converter on an exhaust passage, said method comprising:

receiving a signal indicative of an air-fuel ratio of the exhaust gas in the exhaust passage on an upstream side of the catalytic converter;

computing an estimated quantity of oxygen to be stored based on the signal indicative of the air-fuel ratio of the exhaust gas;

producing an estimated adjustment value;

adjusting an air-fuel ratio of intake air-fuel mixture based on said estimated adjustment value such that said estimated quantity of oxygen to be stored substantially coincides with a predetermined target quantity of oxygen to be stored;

determining whether the engine is misfiring based on a signal indicative of misfiring of the engine; and using a predetermined value instead of said estimated adjustment value to control the air-fuel ratio of the intake air-fuel mixture when misfiring is determined.

18. The method of controlling an air-fuel ratio of exhaust gas as set forth in claim 17, further including stopping said computation of said estimated quantity of oxygen to be stored when misfiring is determined.

19. The method of controlling an air-fuel ratio of exhaust gas as set forth in claim 17, wherein said predetermined value is set based on said estimated quantity of oxygen to be stored that was computed immediately before the misfiring was determined.

20. The method of controlling an air-fuel ratio of exhaust gas as set forth in claim 17, wherein said predetermined value is set such that said air-fuel ratio of said intake air-fuel mixture remains unchanged when misfiring is determined.

* * * * *